US009612561B2

(12) United States Patent
Otani

(10) Patent No.: US 9,612,561 B2
(45) Date of Patent: Apr. 4, 2017

(54) DEVELOPING DEVICE AND IMAGE FORMING APPARATUS INCLUDING THE SAME

(71) Applicant: KYOCERA Document Solutions Inc., Osaka (JP)

(72) Inventor: Shinji Otani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/057,805

(22) Filed: Mar. 1, 2016

(65) Prior Publication Data

US 2016/0266534 A1 Sep. 15, 2016

(30) Foreign Application Priority Data

Mar. 10, 2015 (JP) ..... 2015-046744

(51) Int. Cl.
*G03G 15/08* (2006.01)
*G03G 15/00* (2006.01)
*G03G 21/10* (2006.01)

(52) U.S. Cl.
CPC ..... *G03G 15/556* (2013.01); *G03G 15/0856* (2013.01); *G03G 15/0891* (2013.01); *G03G 15/0889* (2013.01); *G03G 21/105* (2013.01)

(58) Field of Classification Search
CPC .. G03G 15/556; G03G 15/0889; G03G 21/10; G03G 21/105; G03G 21/12
See application file for complete search history.

(56) References Cited

U.S. PATENT DOCUMENTS 6,405,009 B1 * 6/2002 Shinkawa ..... G03G 21/12 399/253
2007/0140764 A1 * 6/2007 Shirai ..... G03G 21/105 399/358
2009/0129837 A1 * 5/2009 Kato ..... G03G 15/0808 399/359

FOREIGN PATENT DOCUMENTS

JP 2001-109246 A 4/2001

* cited by examiner

*Primary Examiner* — Hoang Ngo
(74) *Attorney, Agent, or Firm* — Studebaker & Brackett PC

(57) ABSTRACT

A developing device includes a supplying chamber, an agitating member, a toner carrier, a retaining part and a detecting part. The supplying chamber accommodates a toner replenished from a toner container. The agitating member agitates the toner in the supplying chamber. The toner carrier supplies an electrostatic latent image formed on an image carrier with the toner from the supplying chamber. The retaining part recovers and retains the toner dispersed in the vicinity of the image carrier and the toner carrier. The detecting part detects an amount of the toner in the retaining part. The retaining part is moreover configured to replenish the recovered toner from the retaining part to the supplying chamber when the detecting part detects an amount of the toner in the retaining part more than a predetermined amount in a state where the toner is needed to be replenished to the supplying chamber.

7 Claims, 3 Drawing Sheets

DEVELOPING DEVICE AND IMAGE FORMING APPARATUS INCLUDING THE SAME

INCORPORATION BY REFERENCE

This application is based on and claims the benefit of priority from Japanese Patent application No. 2015-046744 filed on Mar. 10, 2015, the entire contents of which are incorporated herein by reference.

BACKGROUND

The present disclosure relates to a developing device configured to supply a developer to an image carrier and an image forming apparatus including the developing device.

In the electrographic image forming apparatus, an electrostatic latent image formed on the surface of an image carrier (a photosensitive drum) is developed as a toner image in the developing device, and the developed toner image is transferred from the image carrier to a sheet in a transferring unit. A developer which is dispersed in the vicinity of the developing device or the transferring unit or a developer remaining on the image carrier after transferring of the toner image is often recovered, replenished into the developing device and reused.

A technique in which the recovered developer is replenished into the developing device and reused has been in a wide spread. However, the recovered developer has a low amount of charge, is charged in a reverse polarity or often has a small particle diameter. Therefore, there is a tendency that an image failure such as a fogging due to a poor charge in reuse occurs. In addition, when the recovered developer is mixed with a developer supplied from the toner container, a replenishment fogging due to a difference of a charging amount also is generated. Such an image failure is accelerated by aged deterioration of the developer, a decrease of the charging amount due to environmental change or the like.

With respect to the problems, there is a developing device configured to reproduce a developer by applying an external additive into the recovered developer.

SUMMARY

In accordance with an embodiment of the present disclosure, a developing device includes a supplying chamber, an agitating member, a toner carrier, a retaining part and a detecting part. The supplying chamber accommodates a toner replenished from a toner container. The agitating member agitates the toner in the supplying chamber. The toner carrier supplies an electrostatic latent image formed on an image carrier with the toner from the supplying chamber. The retaining part recovers and retains the toner dispersed in the vicinity of the image carrier and the toner carrier. The detecting part detects an amount of the toner in the retaining part. The retaining part is moreover configured to replenish the recovered toner from the retaining part to the supplying chamber when the detecting part detects an amount of the toner in the retaining part more than a predetermined amount in a state where the toner is needed to be replenished to the supplying chamber.

In accordance with an embodiment of the present disclosure, an image forming apparatus includes the developing device described above.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, a developing device and an image forming apparatus according to an embodiment of the present disclosure will be described with reference to the drawings.

Figure 1:
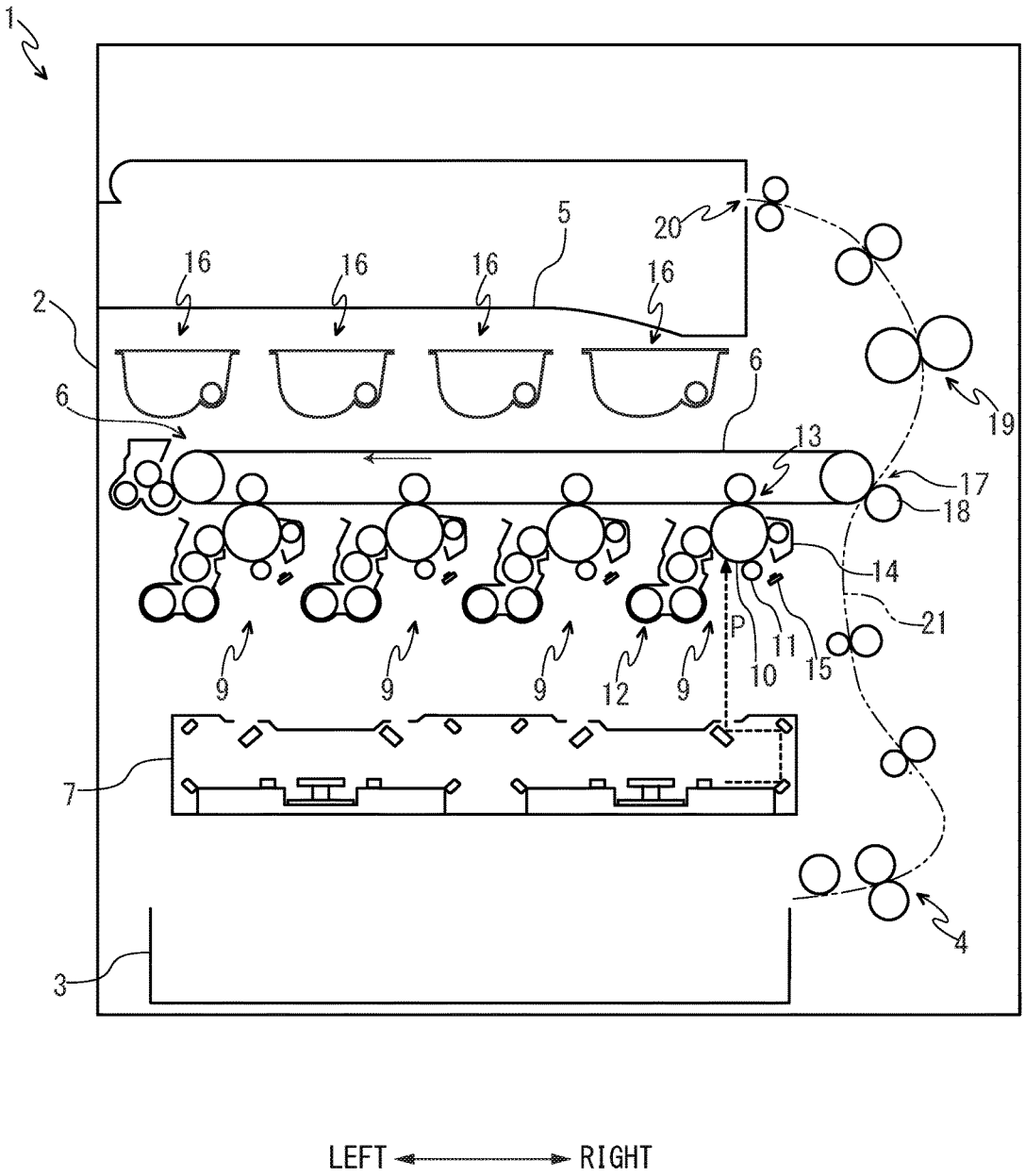
FIG. 1 is a sectional view schematically illustrating an internal structure of a color printer according to an embodiment of the present disclosure.

First, with reference to FIG. 1, the entire structure of a color printer 1 (an image forming apparatus) will be described. FIG. 1 is a sectional view schematically illustrating an internal structure of the color printer according to the embodiment. Hereinafter, it will be described so that the front side of the color printer is positioned at the near side of FIG. 1, and left and right directions are defined on the basis of a direction in which the color printer is seen from the front side.

The printer 1 includes a box-formed printer main body 2. In a lower part of the printer main body 2, a sheet feeder 4 configured to feed sheets from a sheet feeding cartridge 3 configured to store the sheets (not shown) is arranged. On an upper part of the printer main body 2, an ejected sheet tray 5 is arranged.

Inside the printer main body 2, an intermediate transferring unit 6 is installed at the upper side and an exposure device 7 composed of a laser scanning unit (LSU) is installed at the lower side. The intermediate transferring unit 6 has an intermediate transferring belt 8 bridged between a plurality of rollers and four image forming parts 9 are placed for respective colors of toners along a lower part of the intermediate transferring belt 8.

In each of the image forming parts 9, a photosensitive drum 10 is rotatably arranged. Around the photosensitive drum 10, a charger 11, a developing device 12, a primary transferring unit 13, a cleaning device 14 and a static eliminator 15 are placed in order of a primary transfer process. Four toner containers 16 corresponding to the respective image forming parts 9 are installed for respective colors of toners (Y,M,C and K) and each toner container 16 is placed above each developing device 12. In each developing device 12, a two-component developer obtained by mixing a toner having each color with a carrier is filled in a predetermined amount.

Inside the printer main body 2, at a right end of the intermediate transferring unit 6, a transfer roller 18 constituting a secondary transferring unit 17 is arranged across the intermediate transferring belt 8. Above the secondary transferring unit 17, a fixing device 19 is installed, and, above the fixing device 19, a sheet ejecting unit 20 is arranged. In addition, inside the printer main body 2, a sheet conveying path 21 configured to travel from the sheet feeder 4 through the secondary transferring unit 17 and the fixing device 19 to the sheet ejecting unit 20 is arranged at one side (the right side in FIG. 1).

Next, an image forming operation of the color printer 1 having the configuration described above will be described. After charging of the surface of the photosensitive drum 10 by the charger 11, exposure is carried out to the photosensitive drum 10 by laser light (see arrow P) from an exposure unit 7 so as to correspond to image data, and thereby, an electrostatic latent image is formed on the surface of the photosensitive drum 10. The electrostatic latent image is developed as a toner image having correspondent color by the developing device 12, and the toner image is primary-transferred on the surface of the intermediate transferring belt 8 in the primary transferring unit 13. The above-mentioned operation is sequentially repeated by the respective image forming parts 9, and thereby, a full-color toner image is formed on the intermediate transferring belt 8. It is to be noted that the toner and charge remaining on the photosensitive drum 10 is removed by the cleaning device 14 and the static eliminator 15.

On the other hand, a sheet fed from the sheet feeding cartridge 3 by the sheet feeder 4 or from a manual bypass tray (not shown) is conveyed to the secondary transferring unit 17 in a suitable timing for the above-mentioned image forming operation, and then, the toner image having the full-color toner image on the intermediate transferring belt 8 is transferred onto the sheet in the secondary transferring unit 17. The sheet with the secondary-transferred toner image is conveyed to a downstream in the conveying path 21 to go forward to the fixing device 19, and then, the toner image is fixed on the sheet in the fixing device 19. The sheet with the fixed toner image is ejected from the sheet ejecting unit 20 onto the ejected sheet tray 5.

Figure 2:
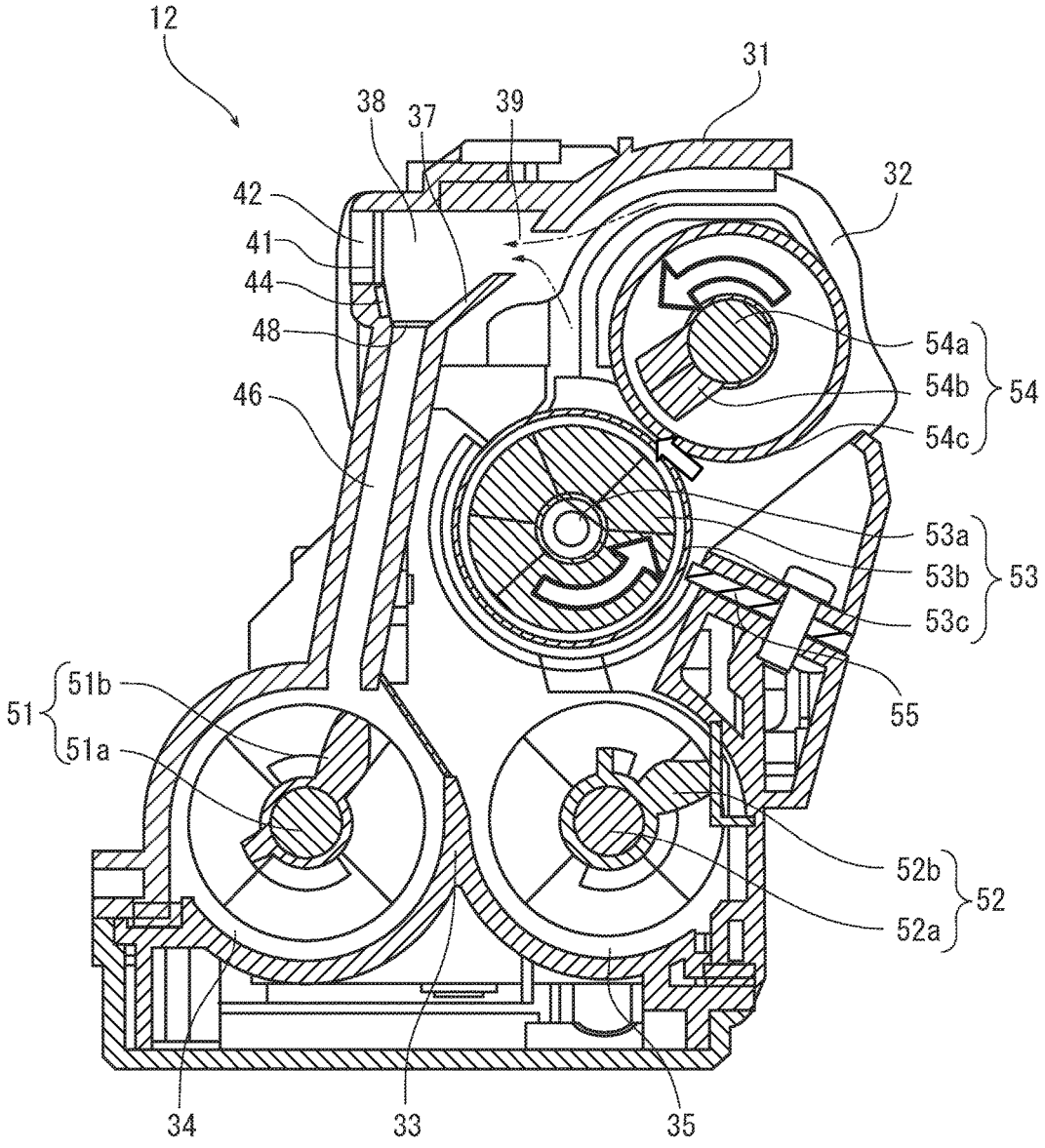
FIG. 2 is a sectional view illustrating an internal structure of a developing device according to the embodiment of the present disclosure.

Next, the developing device 12 will be described with reference to FIG. 2. FIG. 2 is a sectional view schematically showing an internal structure of the developing device.

The developing device 12 includes a casing 31 storing the two-component developer. The casing 31 has a hollow part elongated in front and rear directions, and is formed with an opening 32 facing to the photosensitive drum. 10 in an upper part of a right side face thereof.

In a lower part of the casing 31, a lower partition wall 33 extending in the front and rear directions is vertically arranged, and divides the lower part of the casing 31 into a supplying chamber 34 at the left side and a conveyance chamber 35 at the right side. With the supplying chamber 34, a toner replenishment path (not shown) connected to the toner container 16 is communicated, and the toner is replenished from the toner container 16 to the supplying chamber 34. In addition, the supplying chamber 34 is provided with a toner density sensor (not shown), and in a case in which the toner density detected by the toner density sensor is lower than a predetermined value, the toner is replenished from the toner container 16 to the supplying chamber 34. In addition, in front and rear end parts of the lower partition wall 33, communicating ports communicating the supplying chamber 34 and the conveyance chamber 35 are formed.

At a left upper corner of the casing 31 and above the supplying chamber 34, by an upper partition wall 37 extending in the front and rear directions, a toner retaining part 38 (a retaining part) having a predetermined volume is formed. The toner retaining part 38 is formed such that the sectional area at the lower part thereof is smaller than the upper part thereof. The upper partition wall 37 is formed with an opening 39 extending in the front and rear directions, and the toner retaining part 38 is communicated with the inside of the casing 31, particularly the upper part of the inside of the casing 31 including an opening part 32 through the opening 39. In addition, in the toner retaining part 38, a suction fan 42 is provided together with a toner filter 41, and operation of the suction fan 42 makes the pressure applied to the toner retaining part 38 smaller than the pressure inside the casing 31. It is to be noted that the suction fan 42 and the toner filter 41 may be placed around the center in the front and rear directions in the toner retaining part 38, particularly may be placed in respective front and rear end parts in which the toner is likely to be dispersed.

Further, the toner retaining part 38 is provided with a toner amount sensor 44 (a detecting part) configured to detect the amount of the toner. As a toner amount sensor 44, a weight sensor, a level sensor, a piezoelectric sensor or the like may be used. It is to be noted that in a case in which the toner amount sensor 44 is the weight sensor or piezoelectric sensor, the toner amount indicates a weight, and in a case in which the toner amount sensor 44 is the level sensor, the toner amount indicates a volume.

In addition, the toner retaining part 38 is communicated with the supplying chamber 34 through the conveying path 46. The conveying path 46 is arranged between a bottom part of the toner retaining part 38 and an upper part of the supplying chamber 34 so as to extend in upper and lower directions. In addition, the conveying path 46 has a shutter 48 in an end part at a side of the toner retaining part 38, and when the shutter 48 is opened, the toner retaining part 38 is communicated with the supplying chamber 34 through the conveying path 46.

Inside the casing 31, an agitating screw 51 (an agitating member) placed in the supplying chamber 34, a conveyance screw 52 placed in the conveyance chamber 35, a magnetic roller 53 placed above the conveyance screw 52, a developing roller 54 (a developer carrier, a toner carrier) placed so as to face to the magnetic roller 53 obliquely upward at the right side of the magnetic roller 53, and an ear-breaking blade 55 placed so as to face to the magnetic roller 53 are provided.

The agitating screw 51 and the conveyance screw 52, respectively, are composed of spindles 51*a*, 52*a* and screw blades 52*b*, 52*b* spirally arranged on outer circumference faces of the spindles 51*a*, 52*a*. Each of the spindles 51*a*, 52*a* is supported by the supplying chamber 34 and the conveyance chamber 35 so as to rotate around an axis direction. According to this, the toner supplied from the toner container 16 (see FIG. 1) is mixed with a carrier and the mixture is agitated and electrically charged in a predetermined charging amount. The agitating screw 51 is designed so as to change rotating speed thereof, and is configured to rotate at higher speed than the rotating speed when the toner replenished from the toner container 16 is agitated.

The magnetic roller 53 is configured with a spindle 53*a* unrotatably supported, a magnetic pole member 53*b* fixed on the spindle 53*a* and having a fan shape in a sectional view, a non-magnetic rotating sleeve 53*c* involving the spindle 53*a* and the magnetic pole member 53*b*. The both end parts of the rotating sleeve 53*c* in an axis direction is pivotably supported by the casing 31 so as to rotate, and the rotating sleeve 53*c* is rotated in a counterclockwise direction as shown by an outlined arrow in FIG. 2.

In addition, the magnetic roller 53 is connected to a development bias power source via a bias control circuit (both not shown), and a direct current voltage and an alternate current voltage are applied from the development bias power source to the magnetic roller 53.

The developing roller 54 is configured with a spindle 54*a* unrotatably supported, a developing magnetic pole member 54*b* arranged at a position facing to the magnetic roller 53, and a developing sleeve 54*c* formed in a cylindrical shape with non-magnetic metal material. The developing sleeve 54*c* is rotatably supported in the spindle 54*a*, and is rotated in the counterclockwise direction as shown by an outlined arrow in FIG. 2. The developing roller 54 is placed so as to face to the magnetic roller 53 with a predetermined gap and is exposed from the opening 32 of the casing 31 so as to face to the photosensitive drum 10 (see FIG. 1).

The developing roller 54 is connected to a developing bias power source via a bias control circuit (both not shown), and a direct current voltage and an alternate current voltage is applied from the development bias power source to the developing roller 54.

The ear-breaking blade 55 is attached to the casing 31 at an upstream side in the rotation direction of the magnetic roller 53 relative to a position in which the developing roller 54 faces to the magnetic roller 53, in a state that a tip thereof is inclined to a lower left direction. The tip part of the ear-breaking blade 55 is placed along an axis direction of the magnetic roller 53 with a slight gap from the surface of the magnetic roller 53.

In the developing device 12 having the configuration described above, when the agitating screw 51 and the conveyance screw 52 are rotated, the developer is conveyed in the axis direction while being agitated in the supplying chamber 34 and the conveyance chamber 35, and circulated between the supplying chamber 34 and the conveyance chamber 35 through a communicating route arranged in both end parts of the lower partition wall 33.

The agitated and circulated developer is electrically charged and is conveyed to the magnetic roller 53 by the conveyance screw 52, and forms a magnetic brush on the magnetic roller 53. The magnetic brush on the magnetic roller 53 is subjected to layer thickness regulation by the ear-breaking blade 55, and then, is conveyed to a part in which the magnetic roller 53 faces to the developing roller 54, and makes a toner thin layer on the developing roller 54 by a potential difference between the voltage applied to the magnetic roller 53 and the voltage applied to the developing roller 54 and a magnetic field.

In the toner thin layer made on the developing roller 54, when the developing roller 54 is rotated to a position facing to the photosensitive drum 10, the toner flies due to the potential difference between the developing roller 54 and the photosensitive drum 10 to be supplied to the electrostatic latent image on the photosensitive drum 10, and thereby, the electrostatic latent image is developed as the toner image.

The toner remaining without being used for the development is conveyed again to a position in which the developing roller 54 faces to the magnetic roller 53, and is recovered by the magnetic brush on the magnetic roller 53. The magnetic brush is peeled from the magnetic roller 53 in a homopolar part of the pole member 53*b*, and then falls into the conveyance chamber 35.

In the supplying chamber 34, a predetermined amount of toner is replenished from the toner container 16 based on result detected by the toner density sensor, and the developer is electrically charged homogenously again with an appropriate toner density while circulating between the conveyance chamber 35 and the supplying chamber 34.

During developing operation, the toner having a lower charging amount or the toner having a smaller particle diameter in the developer is dispersed around the developing roller 54 or the photosensitive drum 10 in the casing 31 without being supplied to the electrostatic latent image or being recovered by the magnetic brush. The dispersed toner is drawn toward the toner retaining part 38 having a negative pressure due to the suction fan 42 (see a two-dot chain line in FIG. 2), and passes through the opening 29 of the upper partition wall 27 to enter into the toner retaining part 38 and to be recovered by the toner retaining part 38. The amount of the recovered toner is detected by the toner amount sensor 44.

Figure 3:
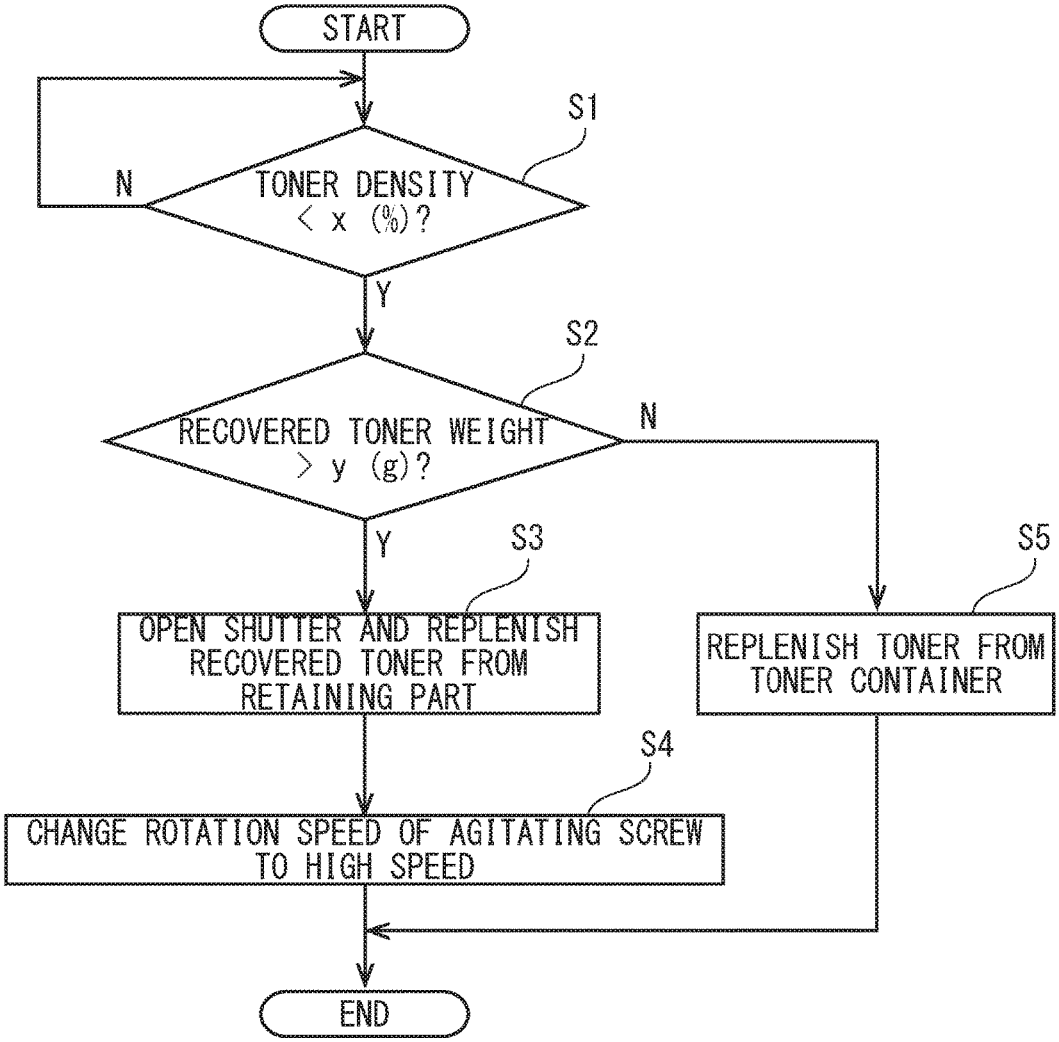
FIG. 3 is a flow chart useful for explaining a procedure of replenishing a toner in a developing device according to the embodiment of the present disclosure.

Next, with reference to FIG. 3, a procedure in which the recovered toner is replenished to the supplying chamber 34 will be described. Decision in the procedure described hereinafter is executed by a controller of the developing device 12. As described above, the toner density is detected by the toner density sensor in the supplying chamber 34. At step S1, when it is decided that the toner density detected by the toner density sensor is lower than a defined density (x %), the procedure proceeds to step S2 to decide whether or not the amount of the recovered toner detected by the toner amount sensor 44 provided in the toner retaining part 38 is larger than a predetermined amount (for example, y g).

When it is decided at step S2 that the amount of the toner recovered in the toner retaining part 38 is larger than the predetermined amount (y g), the procedure proceeds to step S3 to supply the recovered toner to the supplying chamber 34. That is, the toner is not replenished from the toner container 16 but the recovered toner is replenished. Specifically, the shutter 48 of the toner retaining part 38 is opened, and the recovered toner is allowed to fall from the toner retaining part 38 through the conveying path 46 into the supplying chamber 34 by its own weight. Thereby, it is possible to replenish the recovered toner from the toner retaining part 38 to the supplying chamber 34 only by opening the shutter 48.

Next, the procedure proceeds to step S4, the rotation speed of the agitating screw 51 is set to be faster than the rotation speed when the toner replenished from the toner container 16 is agitated. Thereby, the toner is hardly agitated in the supplying chamber 34 to be likely to be subjected to frictional electrification, consequently the toner charging amount is increased. The toner having the increased charging amount is pumped from the magnetic roller 53 to the developing roller 54 while circulating between the conveyance chamber 35 and the magnetic roller 53 to develop electrostatic latent image on the photosensitive drum 10.

On the other hand, when it is decided at step S2 that the amount of the toner recovered into the toner retaining part 38 is not more than the predetermined amount (y g), the procedure proceeds to step S5 to replenish the toner from the toner container 16.

As described above, in the developing device 12 of the present disclosure, the dispersed toner having an unsatisfactory charging amount is recovered to store until the charging amount reaches the predetermined amount, and the toner is replenished to the supplying chamber 34 separately from a fresh toner replenished from the toner container 16. Therefore, the toner having a satisfactory charging amount is scarcely mixed with the toner having the unsatisfactory charging amount in the supplying chamber 34. Then, when the recovered toner having the unsatisfactory charging amount is replenished the agitating speed of the agitating screw 51 is increased to accelerate frictional electrification, and thus the charging amount of the recovered toner can be homogeneously increased. Therefore, even if the recovered toner is replenished, an image failure such as replenishment fogging resulted from the difference in the charging amount does not occur.

In such a manner, the reuse of the recovered toner enables reduction of the amount of the toner consumed as well as restraint of pollution of the toner inside and outside the developing device 12. Incidentally, although the present embodiment has been described about a touchdown development type developing device 12, the present disclosure can be also applied to other developing devices such as a jumping type developing device using a one-component developer and a magnetic brush type developing device using a two-component developer. It is to be noted that, if the one-component developer is used, a timing to replenish the toner is decided on the basis of detection of a weight or volume of the toner in the supplying chamber.

In the present embodiment, the developing device is configured so that the toner retaining part 38 is provided above the supplying chamber 34 and the recovered toner is allowed to fall from the toner retaining part 38 into the supplying chamber 34 by its own weight. Therefore, it is possible to replenish the recovered toner to the supplying chamber 34 with an easy mechanism. Alternatively, the developing device may be configured so that the bottom part of the toner retaining part 38 is configured so as to perform a seesaw movement and, when the toner having a predetermined weight is accumulated in the bottom part, the toner is allowed to fall from the bottom part by the seesaw movement. It is to be noted that in a case in which the toner retaining part 38 cannot be provided above the supplying chamber 34 or in a case in which the distance between the toner retaining part 38 and the supplying chamber 34 is long, a conveyance member forcedly conveying the toner in the conveying path 46 may be provided.

It is to be noted that the description of the embodiment of the present disclosure described above describes suitable embodiments of the developing device and the image forming apparatus in the present disclosure. Therefore, technically preferred various configurations have been illustrated. However, the technical scope of the present disclosure is not limited to the embodiments unless there is description particularly limiting the present disclosure. Further, components in the embodiments of the present disclosure described above may be appropriately replaced with existing components, and various variations including a combination with other existing components may be used. The description of the embodiment of the present disclosure described above does not limit the content of the disclosure described in claims.

What is claimed is:

1. A developing device comprising:

a casing having an opening part facing to an image carrier;

a supplying chamber accommodating a toner replenished from a toner container;

an agitating member agitating the toner in the supplying chamber;

a toner carrier supplying an electrostatic latent image formed on the image carrier with the toner from the supplying chamber;

a retaining part recovering and retaining only the toner dispersed in the vicinity of the image carrier and the toner carrier; and a detecting part detecting an amount of the toner in the retaining part, wherein the retaining part is configured to include a suction fan and a toner filter and to be communicated with the inside of the casing including the opening part, and then, to recover the toner by making a pressure in the retaining part negative by using the suction fan, and further, to replenish the recovered toner from the retaining part to an upper side of the agitating member inside the supplying chamber when the detecting part detects an amount of the toner in the retaining part more than a predetermined amount in a state where the toner is needed to be replenished to the supplying chamber.

2. The developing device according to claim 1, wherein the agitating member is provided so as to agitate the toner at each of different agitating speeds, the agitating member is configured to make an agitating speed when the toner recovered in the retaining part is replenished to the supplying chamber faster than another agitating speed when the toner is replenished from the toner container.

3. The developing device according to claim 1, further comprising:

a conveying path communicating the retaining part with the supplying chamber; and a shutter opening and closing the conveying path, wherein the retaining part is provided above the supplying chamber, the retaining part is configured such that the toner in the retaining part is replenished through the conveying path the supplying chamber by its own weight by opening the shutter based on result detected by the detecting part.

4. The developing device according to claim 1 further comprising:

a controller decides that the toner is needed to be replenished from the retaining part to the supplying chamber in a case where density of the toner in the supplying chamber is lower than predetermined density.

5. An image forming apparatus comprising:

the developing device according to claim 1.

6. The image forming apparatus according to claim 5 further comprising:

the toner container, wherein the toner container is configured to replenish the recovered toner from the toner container to the supplying chamber when the detecting part detects the toner in the toner container more than the predetermined amount in a state where the toner is needed to be replenished to the supplying chamber.

7. The developing device according to claim 1, wherein the suction fan and the toner filter are placed in each of front and rear end parts in the retaining part in which the toner is likely to be dispersed.

* * * * *